United States Patent [19]

Tanaka et al.

[11] Patent Number: 5,074,531

[45] Date of Patent: Dec. 24, 1991

[54] SEALING APPARATUS FOR SINTERING MACHINE

[75] Inventors: Kunihiro Tanaka; Naoki Ishihara; Youichi Ezawa, all of Chiba, Japan

[73] Assignee: Kawasaki Steel Corporation, Hyogo, Japan

[21] Appl. No.: 465,248

[22] Filed: Mar. 27, 1990

[30] Foreign Application Priority Data

May 9, 1989 [WO] PCT Int'l Appl. ... PCT/JP89/00475

[51] Int. Cl.[5] ..... C21B 7/16

[52] U.S. Cl. ..... 266/179; 266/178

[58] Field of Search ..... 266/179, 180, 178, 145

[56] References Cited

U.S. PATENT DOCUMENTS 2,506,569 5/1950 Agnew ..... 266/179

3,713,634 1/1973 Möller et al. ..... 266/179

*Primary Examiner*—S. Kastler

*Attorney, Agent, or Firm*—Bierman and Muserlain

[57] ABSTRACT

Sealing apparatus of wind boxes at both the ore charge and discharge sides of a Dwight-Lloyd sintering machine provides a plurality of seal members disposed in series in close contact with the bottom surface of pallets of the sintering machine, and a seal chamber communicating with a space provided between these seal members. The seal members are rotatable rolls having seal plates projectingly installed radially on the outer periphery thereof, and may be rolls with these seal plates held in close contact with the bottom surface of the pallets and the inner surface of the seal chamber, or may be flat seal plates with their flat surface firmly pressed against the bottom surface of the pallets. In the seal chamber is mounted an independent exhaust fan for the removal of air, further improving sealing performance. According to the apparatus, it is possible to decrease the amount of sintering exhaust gas, power consumption of main induced fan, and processing costs at subsequent desulfurization and denitrification equipment.

8 Claims, 9 Drawing Sheets

SEALING APPARATUS FOR SINTERING MACHINE

BACKGROUND OF THE INVENTION:

1. Industrial Field of Utilization

The present invention relates to an air-sealing apparatus of wind boxes to be equipped at both ends in the direction of travel of pallets of a Dwight Lloyd continuously movable sintering machine. 2. Prior Art A Dwight-Lloyd moving grate type sintering machine is an equipment for sintering raw materials containing combustible components being carried on a moving pallet. In this equipment, the combustible components of the raw material to be sintered are ignited from above while gas is drawn in by a suction fan connected to wind boxes mounted beneath the pallets. Burning of the combustible components is moved from the upper toward lower layers of the raw material, enabling the sintering of the raw material on the pallets.

In the Dwight-Lloyd sintering machine, a conventional air-sealing structure of the wind box on both the ore charge and discharge sides is of such a type that the surface of a flat seal plate is pressed against the bottom surface of the pallets. Actually, however, it was impossible to press the seal plate surface into close contact with the pallets because of the pallets' deflecting deformation.

Therefore, there was such a serious problem that the invasion of outside air into the wind box through the sealed section on the ore charge and discharge sides increases energy consumption and processing cost at the exhaust gas processing equipment.

Recently, however, there has been proposed such a sealing apparatus for sintering machine in Japanese Utility Model Laid-open No. 62-38598 that a plurality of seal plates are inclined toward the direction of movement of pallets with the top section of the seal plates bent so as to be parallel with the bottom surface of the pallets, and with ceramics seal plates installed on the top parallel surface. In this equipment, fibrous objects are respectively inserted and held inside of a plurality of seal plates to prevent the deflection of the seal plates, but the sintered material falling from the pallet accumulates in the fibrous objects and disturbs the motion of the seal plates, giving an adverse effect to smooth sealing operation and, accordingly, to the durability of the sealing apparatus. Also, the angle of inclination of the seal plates gradually moves toward the perpendicular side, and the seal plates are pressed into firmer contact with a pallet that has undergone great deflective deformation, resulting in wear or falling of holding members and falling of ceramics plates.

SUMMARY OF THE INVENTION

It is an object of the present invention to provide a sealing apparatus of wind boxes on the ore charge and discharge sides of a sintering machine which will leak very little air.

I is another object of the present invention to provide a means for preventing the invasion of even a slight amount of leaking air into the wind boxes.

A further object of the present invention resides in the reduction of energy consumption and processing cost in the exhaust gas processing equipment of the sintering machine.

As a result of investigation on the prevention of air leaks from the sealing apparatus of wind boxes disposed on both the ore charge and discharge sides of the sintering machine, the inventors have developed a sealing apparatus provided with a plurality of sealing members arranged in series and in contact with the bottom surface of the pallets, and a seal chamber communicating with a space defined between the plurality of sealing members. A better effect is obtainable by mounting a independent fan for drawing the air out from the seal chamber.

It is preferable to use, as a sealing member, a rotatable roll with seal plates installed radially and projectingly on the outer periphery of the roll. A sealing apparatus of good sealing performance is obtainable by providing such a constitution that the top ends of these seal plates installed radially and projectingly on the outer periphery of the roll is held in close contact with the bottom surface of the pallets and the inside surfaces of the seal chamber. A much better sealing performance can be assured by projectingly installing a number of wires radially along both the surfaces of each seal plate on the roll provided with the seal plates.

The seal chamber is located under the roll with the seal plates, isolated from the outside air, and furnished with a duct for drawing air out from the chamber and discharging it out of the exhaust gas processing system of the sintering machine, an exhaust fan independent of a main induced fan of the sintering machine, and an exhaust stack.

Furthermore, the present invention includes a sealing apparatus, which has a plurality of air-sealing apparatus with their flat surfaces firmly pressed against the bottom surface of the pallets, a seal chamber disposed in the intermediate section, and a duct, an exhaust fan and an exhaust stack for discharging the outside air that has entered from this seal chamber and out of the exhaust gas processing system of the sintering machine.

DESCRIPTION OF THE PREFERRED EMBODIMENT:

The present invention pertains to an equipment designed to prevent the entrance of outside air into wind boxes on both the ore charge and discharge sides of the sintering machine by mounting rotating roll-type sealing members, and a duct, a leaking air exhaust fan and an exhaust stack for discharging the leaking air out of the sintering exhaust gas system.

The rotating roll-type sealing apparatus is constituted of a combination of one or a plurality of rolls with seal plates and a seal chamber. Rotating the roll fitted with seal plates, with the top ends of the seal plates held in contact with the bottom surface of the pallets, can discharge outwardly the outside air likely to enter the wind box, thereby enabling to seal the wind box.

In this case, the roll fitted with the seal plates sometimes fails to completely prevent the entrance of the outside air; that is, a slight amount of outside air flows thereinto. However, the outside air can be drawn out of the system by the use of the air exhaust fan in the seal chamber, thus preventing the invasion of the outside air into the wind box.

Thus discharging the air from the inside of this seal and chamber can decrease the amount of sintering exhaust gas, reduce the fan power consumption, and lower a processing cost of subsequent desulfurization and denitrification equipment. In addition, it is possible to decrease fuel consumption for CO oxidation in the denitrification preheating furnace by improving an oxidation rate of CO in the exhaust gas in the gas oxidation equipment.

Figure 6:
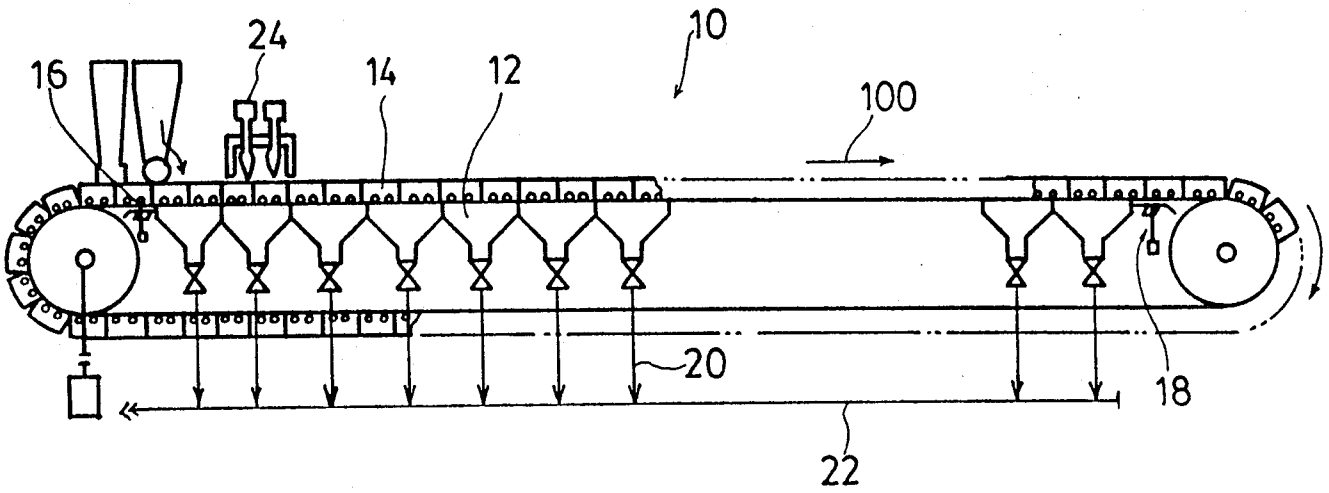
FIG. 6 is a general schematic view in explanation of a Dwight-Lloyd sintering machine.
Figure 7:
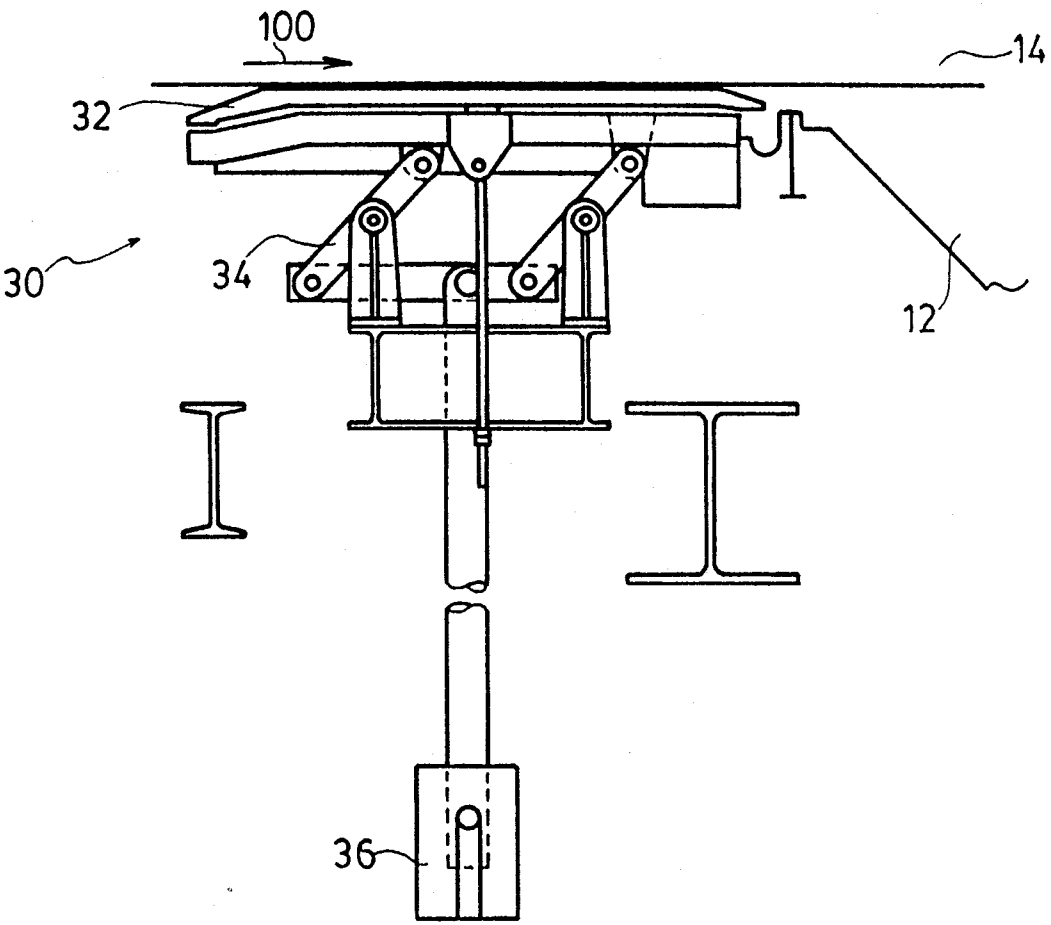
FIG. 7 is a side view of a conventional sealing apparatus.
Figure 8:
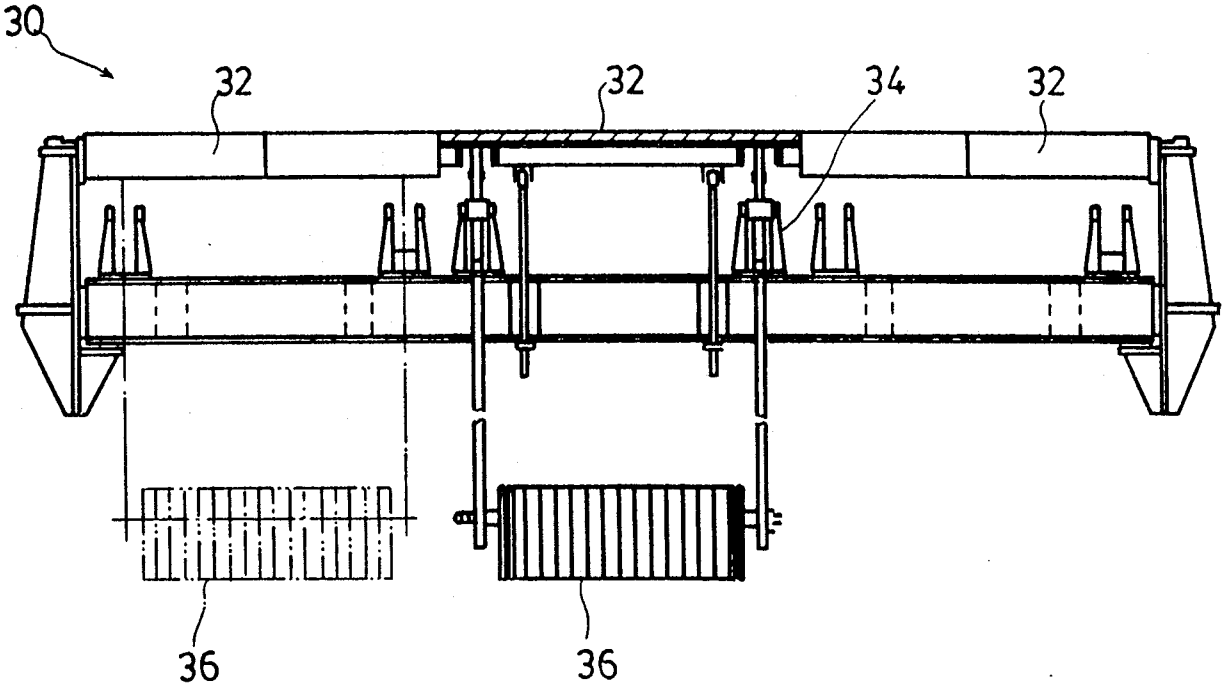
FIG. 8 is a front view thereof.

FIG. 6 is a general schematic drawing of a Dwight-Lloyd sintering machine 10. An air seal 16 on the raw material charge side and an air seal 18 on the sintered ore discharge side of wind boxes 12 are of such an installation as that of the air-sealing apparatus 30 as shown in FIGS. 7 and 8. FIG. 7 is a side view, and FIG. 8 is a front view partly omitted.

This air-sealing apparatus 30 is of such a constitution that a seal plate 32 is supported by a hinge mechanism 34 and pushed upwardly by a counterweight, thus preventing the invasion of the outside air into the wind boxes 12 through a clearance between this seal plate 32 and the bottom surface of pallets 14.

The pallet 14 is likely to be subjected to deflection because of the load and heat of raw materials loaded thereon and a suction pressure during use. Usually, it is deflected 10 mm or less. In the conventional air-sealing apparatus 30, the seal plate 32 is t be pressed in contact with the lower surface of the pallet 14 by the use of the counterweight 36; actually, however, the seal plate is set so that its upper surface will be about 5 mm apart from the lower surface of a normal pallet 14 to allow the deflection of the pallet 14.

Therefore, the conventional air-sealing apparatus has such a problem that when the pallet 14 is not deflected, there exists a 5 mm clearance between the lower surface of the pallet 14 and the upper surface of the seal plate 32, through which the outside air flows into the wind box 12. In the meantime, when the deflection of the pallet 14 is in excess of 5 mm, the air-sealing apparatus 30 is pushed downwardly and accordingly the seal plate 32 come in contact with the lower surface of the pallet 14, which therefore travels while rubbing on the upper surface of the seal plate 32. In this case, however, since the pallet 14 is deflected, the lower surface thereof partly come in contact at the center part deflecting most with the seal plate, there remains a clearance in other part of the seal plate 32 which is not in contact with the lower surface of the pallet 14, allowing the invasion of the outside air into the wind box 12.

Figure 9:
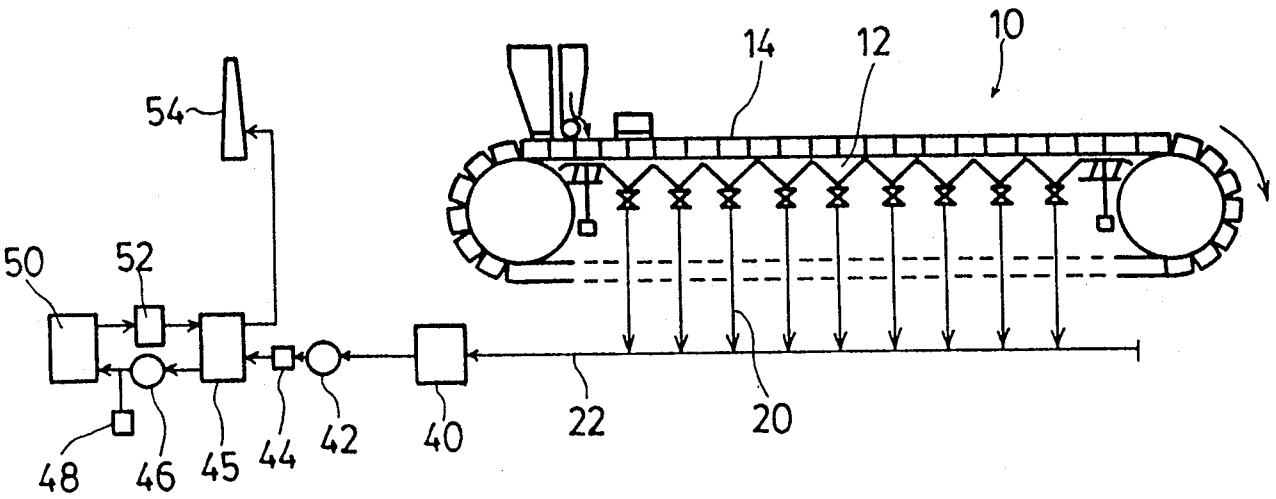
FIG. 9 is a schematic diagram of a sintering exhaust gas processing system.

The exhaust gas processing system of the sintering machine, as shown in FIG. 9, is so designed that the exhaust gas in the sintering machine 10 is drawn out by a main induced fan 42 through the window box 12, a wind leg 20, a gas main duct 22, and a dust collector 40. On the downstream side of the main induced fan 42 are disposed a desulfurization equipment 44, a heat exchanger 45, a blower for denitrification equipment 46, a denitrification reactor 50, and a CO oxidation equipment 52, so that the exhaust gas can be discharged out into the atmosphere through these equipment and finally at the stack 54.

Figure 10:
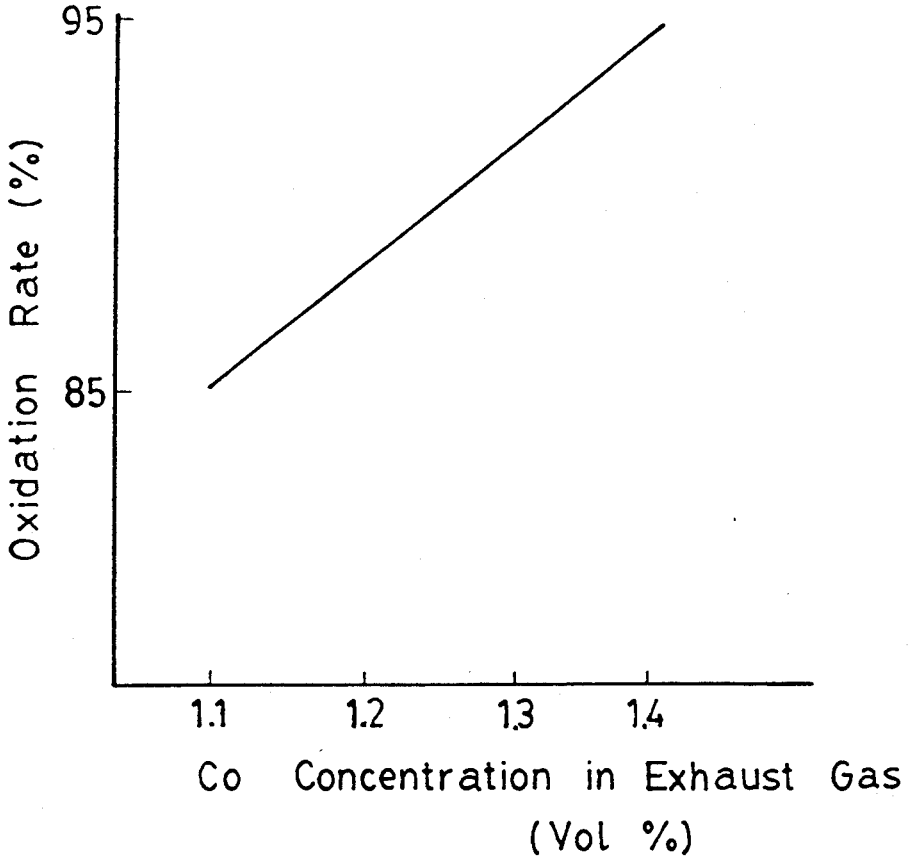
FIG. 10 is a graph showing a relationship between the CO concentration in exhaust gases and oxidation rate.

When the outside air flows into the wind box 12, the amount of the exhaust gas increases, increasing the power consumption of the main induced fan 42 and the blower for denitrification equipment 46 and also increasing the processing cost required by the desulfurization equipment 44 and the denitrification reactor 50. The concentration of CO in the exhaust gases from the sintering machine 10 is lowered by the invasion of the outside air. In the CO oxidation equipment 52, as shown in FIG. 10, the oxidation rate lowers and consequently the quantity of oxidizing heat is decreased, resulting in a decreased heat exchange volume of the heat exchanger 45 and accordingly in an increased quantity of heat to be additionally supplied to the denitrification preheating furnace 48.

EMBODIMENTS

Figure 1:
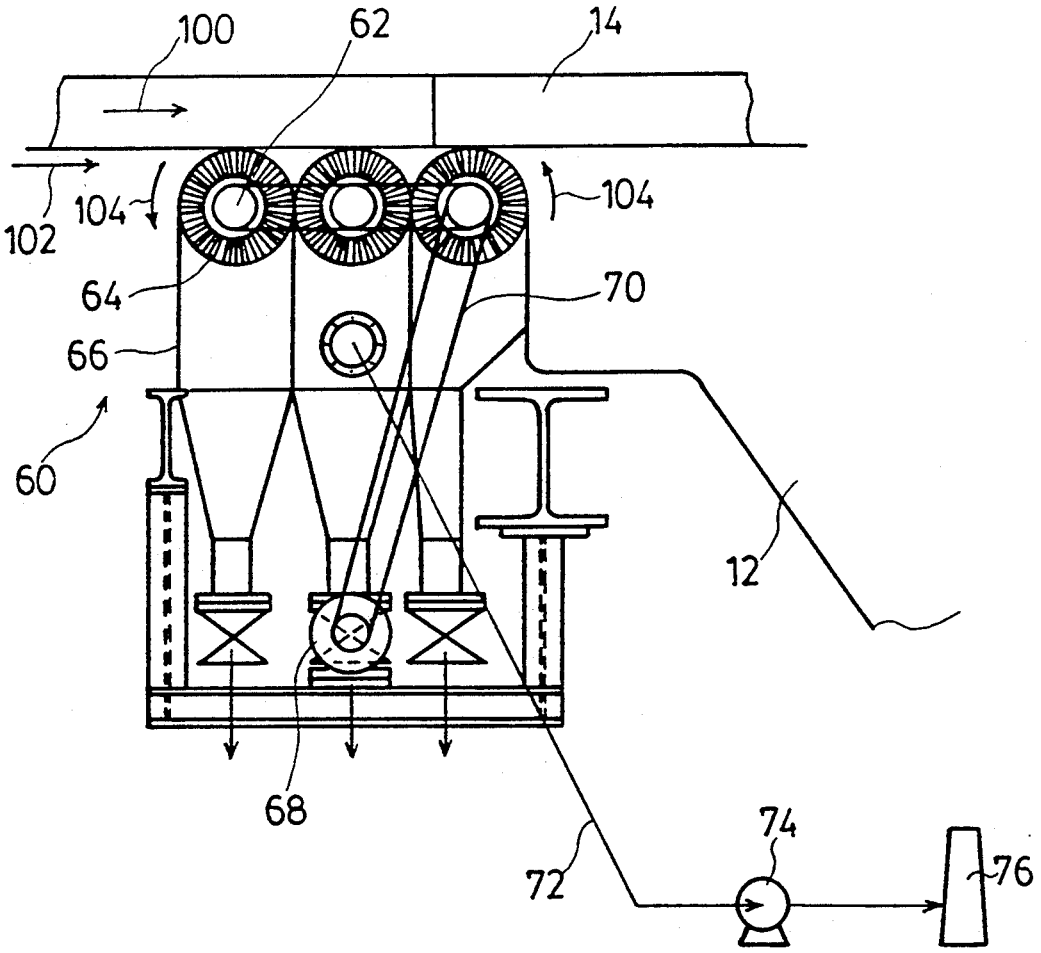
FIG. 1 is a side view of a sealing apparatus of embodiment according to the present invention.
Figure 2:
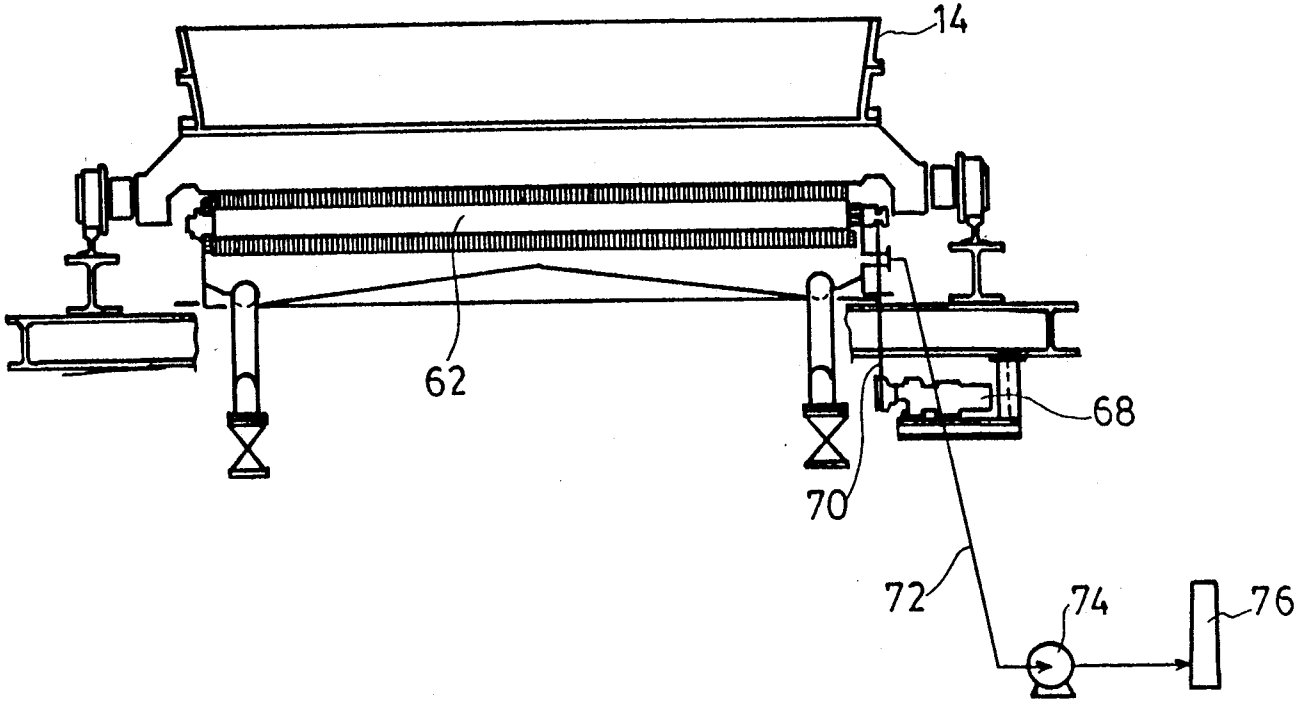
FIG. 2 is a front view thereof.
Figure 3:
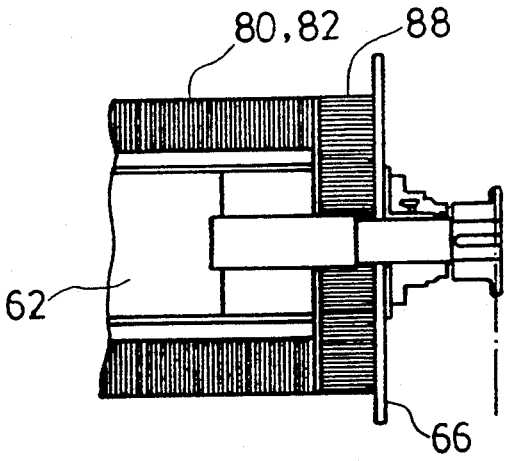
FIG. 3 is a partly sectional view of a roll provided with seal plates.

The embodiment of the present invention will be described with reference to the drawings. FIG. 1 is a side view of the rotating roll-type sealing apparatus according to the embodiment of the present invention. FIG. 2 is a front view thereof. As shown in FIG. 1, a rotating roll-type sealing apparatus 60 used as a sealing apparatus of the sintering machine of the embodiment is constituted of a plurality of rolls (seal members 62 fitted with seal plates and seal chambers 66 disposed thereunder.

Figure 4:
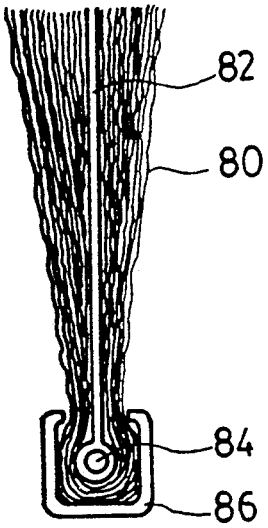
FIG. 4 is a detailed sectional view of a seal plate.

The roll 62 with seal plates has seal plates 82 installed radially on the outer periphery of the roll 62 provided with a shaft. The seal plate 82 consists of one or a plurality of thin steel sheets protected with a number of wire brushes 80 as shown in FIG. 4. This seal plate 82 is securely tied with a steel cap 86 with a core rod 84 disposed at center. The seal plate 82 of this type is radially installed on the outer periphery of the roll 62. On both ends of the roll 62 are attached side seal plates protected by a number of wires 88 projected in the direction of the roll axis in consideration of thermal expansion.

The roll 62 has seal plates 82 fitted thereon and held in close contact with the lower surface of pallets. The seal plates 82, therefore, are installed so that their top ends will bite about 10 mm long into the bottom surface of the pallets. Also, the wires 88 installed on the side of the roll 62 fitted with seal plates are manufactured to the length that their top ends are overlapped about 10 mm long with the inner surface of the chamber 66, being held in firm contact with this inner surface.

The roll 62 fitted with seal plates as described above is rotated at a high speed by a motor 68 through a drive transmission system including a chain 70 and a sprocket, in a direction 104 reverse to the direction 102 of inflow of the outside air. Thus, the invasion of the outside air into the wind box 12 is prevented and the outside air is discharged in an opposite direction.

The sintering raw material that fell from the pallets 14 is regularly discharged from the lower part of the seal chamber 66.

In the embodiment of the present invention, as shown in FIG. 1, the rotating roll-type sealing apparatus 60 composed of three rolls 62 fitted with seal plates is mounted as air-sealing apparatus on both the ore charge and discharge sides of wind boxes of the sintering machine 10. The roll 62 with the seal plates is rotated at a speed of 50 revolutions per minute. In consequence, the leaking air through the sealing apparatus on the ore charge and discharge sides has been decreased up to about 10 percent as compared with the conventional sealing apparatus.

Furthermore, as a result of operation of the leaking air exhaust fan 74 carried out while rotating the roll 62 fitted with seal plates, the amount of the leaking air could be nearly completely prevented, thus decreasing a power required by the main induced fan of the sintering machine and the desulfurization and denitrification costs by about 25 percent.

In the meanwhile, since no outside air invasion (leaks) into the sintering exhaust gas, the concentration of the CO in the exhaust gas can be increased, and the oxidation rate of CO can be improved, with the result that the quantity of fuel to be used in the denitrification preheating furnace can be reduced about 20 percent.

Figure 5:
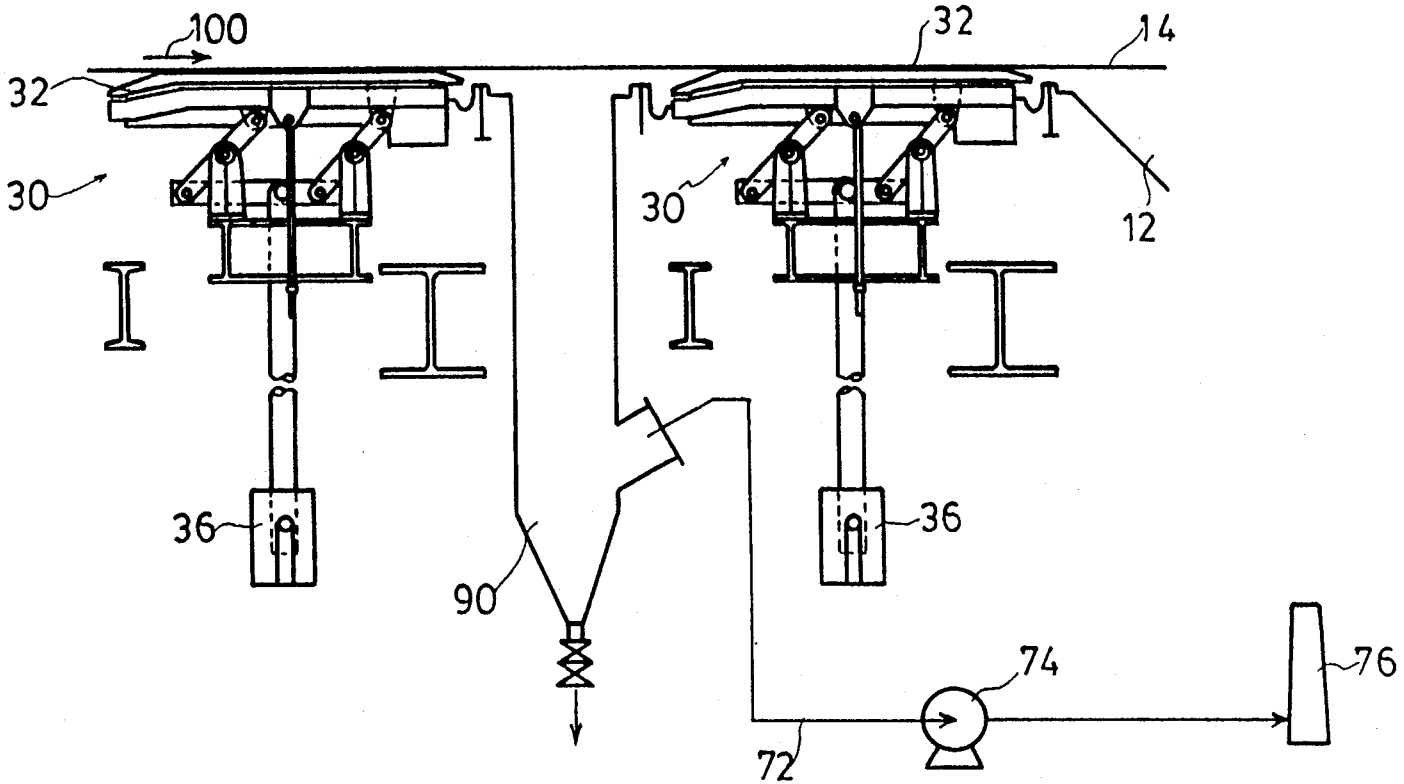
FIG. 5 is a side view of another embodiment.

In another embodiment of the present invention, as shown in FIG. 5, air-sealing apparatus, like the conventional air-sealing apparatus 30, are located on both sides of the intermediate chamber 90, and are annexed with a duct 72, a leaking air discharge fan 74 and an exhaust stack 76 for discharging the leaking air from the intermediate chamber 90 out of the sinter exhaust gas processing system. The use of these apparatus can also decrease the amount of sintering exhaust gas, power consumption of the main induced fan, and desulfurization and denitrification costs in the subsequent equipment. Besides, it is possible to reduce fuel consumption in the denitrification preheating furnace by improving the CO oxidation rate.

As aforementioned, the sealing apparatus of the present invention insures nearly complete prevention of air leaks from the ore charge and discharge sides of the sintering machine.

What is claimed is:

1. A sealing apparatus of a wind box on both the ore charge and discharge sides of a Dwight-Lloyd sintering machine comprising a plurality of sealing members installed in series in contact wit the bottom surface of pallets of said sintering machine and a seal chamber communicating with a space disposed between said plurality of seal members, said sealing members being rotatable rolls with seal plates projectingly installed radially on the other periphery of the rolls, and said seal plates of said rolls being held in close contact with the bottom surface of pallets and with the inner surface of said seal chamber.

2. A sealing apparatus for a sintering machine of claim 1 further comprising an independent exhaust fan for the removal of air from the said seal chamber.

3. A sealing apparatus for a sintering machine of claim 1 wherein a number of wires are projectingly installed radially along both sides of the said seal plates.

4. A sealing apparatus for a sintering machine of claim 2 wherein a number of wires are projectingly installed radially along both sides of the said seal plates.

5. A sealing apparatus for a sintering machine of claim 1 wherein side seal plates which are protected by a number of wires projected in the direction of the roll axis are attached on both ends of the roll.

6. A sealing apparatus for a sintering machine of claim 2 wherein side seal plates which are protected by a number of wires projected in the direction of the roll axis are attached on both ends of the roll.

7. A sealing apparatus for a sintering machine of claim 3, wherein side seal plates which are protected by a number of wires projected in the direction of the roll axis are attached on both ends of the roll.

8. A sealing apparatus for a sintering machine of claim 4 wherein side seal plates which are protected by a number of wires projected in the direction of the roll axis are attached on both ends of the roll.

* * * * *